United States Patent [19]

Faust

[11] Patent Number: 4,752,092

[45] Date of Patent: Jun. 21, 1988

[54] REMOTELY OPERATED HOOD LOCK RELEASE BLOCKER ASSEMBLY FOR A VEHICLE

[75] Inventor: James H. Faust, Hoffman Estates, Ill.

[73] Assignee: ABC Auto Alarms, Inc., Elk Grove Village, Ill.

[21] Appl. No.: 37,210

[22] Filed: Apr. 10, 1987

[51] Int. Cl.[4] ..... E05C 1/16

[52] U.S. Cl. ..... 292/336.3; 292/201; 292/DIG. 14

[58] Field of Search ..... 292/144, 125, 201, 216, 292/225, 336.3, DIG. 14, DIG. 25

[56] References Cited

U.S. PATENT DOCUMENTS

| | | | |
|---|---|---|---|
| 3,287,054 | 11/1966 | Russell et al. | 292/336.3 |
| 4,045,064 | 8/1977 | Okada | 292/125 |
| 4,252,351 | 2/1981 | Yoshino et al. | 292/336.3 |

*Primary Examiner*—Richard E. Moore

*Attorney, Agent, or Firm*—Silverman, Cass, Singer & Winburn, Ltd.

[57] ABSTRACT

A remotely controlled hood lock release blocker assembly for preventing the release of a vehicle hood latch which includes a cable coupled to the hood release. The cable is secured to a platform journaled for rotation along the full length of a limited arc required to effect release of the hood latch and one of an electromagnetically controlled lever and mechanical dead bolt is provided for interfering with the rotation of the platform the full length of the limited arc preventing completion thereof whereby to prevent release of the hood. A control device in the form of a key operated energizing device for the electromagnet or a key operated control for withdrawing the lever and dead bolt respectively, is provided remote from the blocker assembly for changing the condition of the lever and dead bolt from interferent to non-interferent condition respectively.

19 Claims, 1 Drawing Sheet

FIG. 1
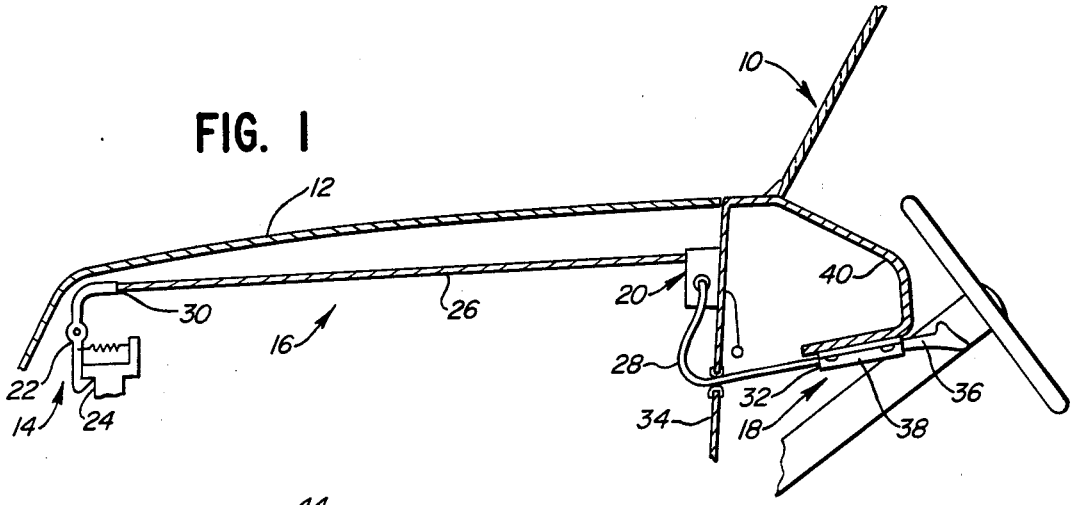
FIG. 2
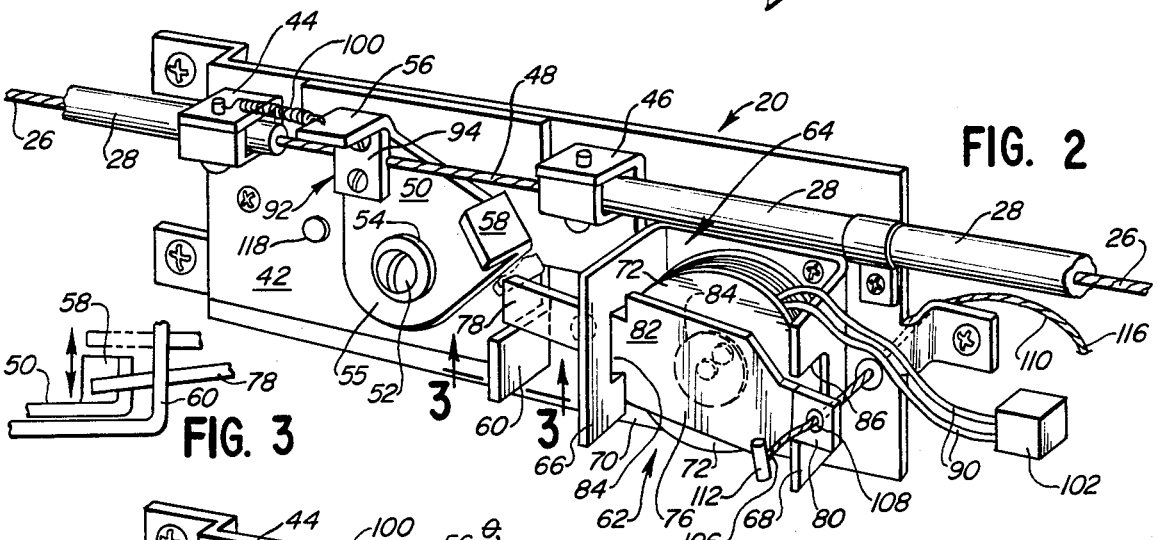
FIG. 3
FIG. 4
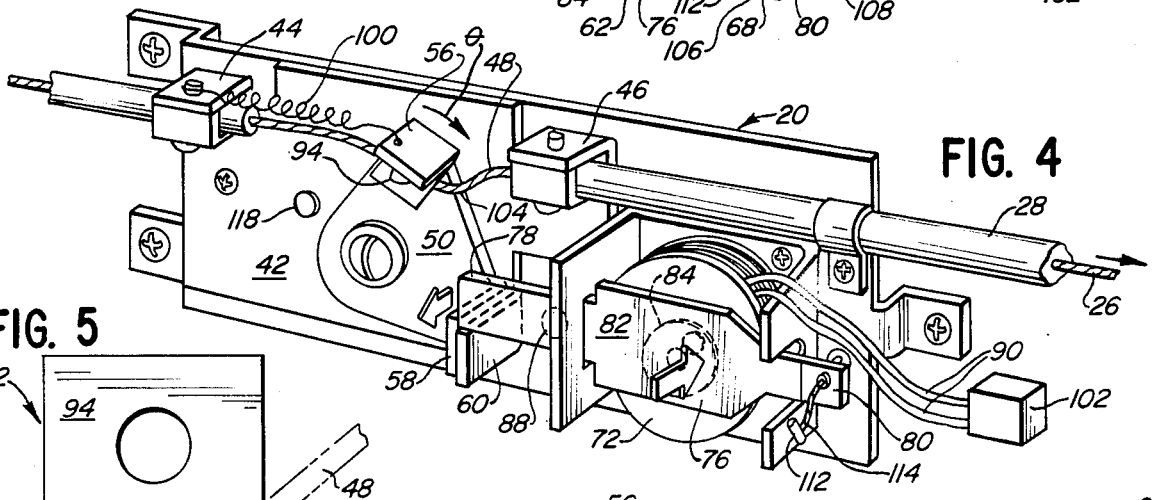
FIG. 5
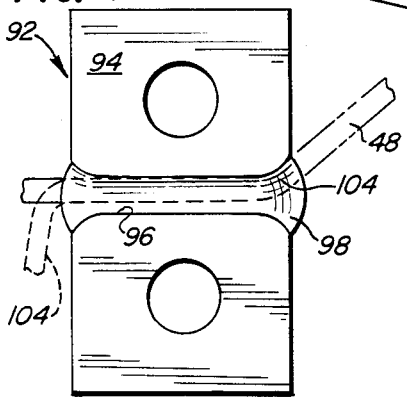
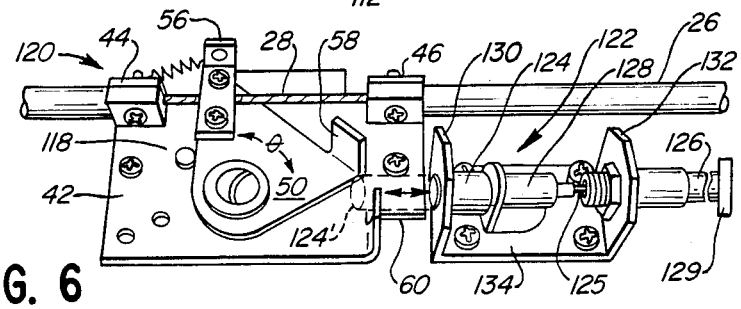
FIG. 6

REMOTELY OPERATED HOOD LOCK RELEASE BLOCKER ASSEMBLY FOR A VEHICLE

BACKGROUND OF THE INVENTION

1. Field of the Invention

This invention relates generally to hood locks for vehicles and more particularly provides a remotely controlled hood lock release blocker assembly including means operable between a condition blocking release of the hood lock and a condition enabling such release.

2. Description of the Prior Art

Vehicle theft prevention systems include components intended to provide protection and warnings against any unauthorized attempts to gain access to the vehicle for the purpose of theft either of the vehicle or the contents of the interior thereof. Many types of visual and audible alarms are provided which are triggered by breaking windows. tampering with ignition systems or by causing the vehicle to be moved. Starting of the vehicle either by crossing of the ignition wires or by gaining access to the interior of the engine compartment and manipulating the ignition system from the interior of the engine compartment frequently are methods for stealing the vehicle.

Hood locks are provided to assure that the normally spring biased hood will not accidently open during the operation of the vehicle. Conventionally such locks comprise a latch lever on the hood, engaging a catch or keeper located in the interior of the engine compartment. The latch lever is spring biased normally engaged with the keeper. A cable is provided for disengaging the latch lever from the keeper. The cable is brought into the front passenger compartment through the firewall and dashboard of the vehicle, terminating in a handle. Manipulation of the handle, as by pulling, will cause the latch lever to be fully or partially disengaged from its keeper and either, the hood is fully released or ready for release by an operator from exterior of the vehicle. The hood lock and the release means heretofore provided has become a weak link in the chain of protection presently available against theft of the vehicle and/or various operating components located within the engine compartment. Additional precautions should be provided, one of which would comprise means for preventing release of the hood lock by use of a positive hood lock release assembly which is operable only from within the passenger compartment and with the use of a restricted distribution key or the like being required to enable the release.

SUMMARY OF THE INVENTION

The invention provides a blocker assembly for a hood lock release for a vehicle, said assembly having means operable to block release of the hood latch lock and electromechanical or mechanical means to render said blocking means ineffective to bar the release of the hood lock. Preferably, said mechanical or electromechanical means are rendered effective by key means operable remotely from the interior of the vehicle.

BRIEF DESCRIPTION OF THE DRAWING

FIG. 1 is a representation of the hood and front compartment of a vehicle having the hood lock release blocker assembly according to the invention installed therein;

FIG. 2 is a perspective view of the hood lock release blocker assembly embodying the invention;

FIG. 3 is a detail section taken along lines 3—3 of FIG. 2 in the direction indicated generally;

FIG. 4 is a perspective view of the hood lock release blocker assembly of FIG. 2 illustrating the condition thereof subsequent to operation of the release mechanism of the invention;

FIG. 5 is a bottom planar view of a detail of FIG. 4;

FIG. 6 is a reduced perspective view of a modified form of the invention.

DESCRIPTION OF THE PREFERRED EMBODIMENTS

Referring to the drawings, in FIG. 1 there is illustrated a diagrammatic representation of the forward section of a vehicle 10 showing the hood 12 in closed condition, the hood lock 14 installed within the engine compartment 16, the cnventional hood lock release 18 within the forward portion of the passenger section and the hood release blocker assembly 20 embodying the invention installed within the engine compartment 16 at a location intermediate the hood lock 14 and the conventional hood lock release 18.

The hood lock 14 comprises a pivotable latch 22 engaged with a keeper 24, the hood lock 14 usually being mounted at the forward portion of the engine compartment 16. The conventional hood lock release 18 comprises an elongate braided cable 26 within an outer sheath or cover 28. One end 30 of the cable 26 is coupled to the latch 22 and the opposite end 32 is brought through the firewall 34 at the rear of the engine compartment 16 and secured to a handle 36 arranged on a bracket 38 so that the handle is accessible at the dash board 40. The handle 36 is adapted to be pulled to cause the latch 22 to swing out of engagement with the keeper 24 whereby to release the hood 12.

The hood lock release blocker assembly 20 according to the invention prevents the release of the hood 12 in the absence of a specific activity performed by the operator. The blocker assembly 20 is mounted at a preferred location within the engine compartment 16. The cable 26 is brought through said assembly 20 intermediate the hood latch 22 and the location at the firewall where the cable 26 is drawn through the firewall 34.

Referring to FIGS. 2–4, the blocker assembly 20 is illustrated disposed on its side for viewing convenience and comprises a base plate 42 for mounting onto a selected portion of the vehicle within the engine compartment 16. A pair of guide clamps 44, 46 are positioned spaced apart along a length of the base plate 42. The cable 26 with its sheath 28 is secured in the respective clamps 44, 46 so that a bared portion 48 thereof (sheath removed) extends horizontally therebetween. A planar platform 50 having a generally triangular perimetric configuration is mounted to the base plate 42 by bolt 52 and washer 54 at a location adjacent the apex 55 so that it is journaled for rotation through an arc 0. The platform 50 is provided with a pair of spaced upstanding flanges 56, 58 at the corners of said platform 50. An upstanding flange 60 is formed on the base plate 43 disposed perpendicular thereto and located at the termination of the arc 0 to limit the extent of rotation of said platform 50. A housing 62 is mounted to the base plate 42 at a location adjacent the flange 60 and comprises a U-shaped formation 64 and a cover (not shown) including spaced walls 66, 68 and a connecting base plate 70. Walls 66 and 68 are parallel one to the other and normal to the base plate 70. Electromagnetic wafer 72 is seated on the connecting base 70 between the walls 66 and 68 and normally covered by the cover (not shown). A thin elongate lever 76 is disposed across the electromagnetic wafer 72. Lever 76 has a pair of planar opposite narrow end portions 78, 80 and a larger midportion 82 disposed overlying the electromagnetic wafer 72 and connected thereto by coil spring 84. End 78 of the lever 76 extends through the slot or passage 84 formed in the wall 66 while the opposite end 80 of lever 76 extends through passage 86 formed in wall 68 of the U-shaped formation 64. Passage 86 as shown is in the form of a notch opening to the top of wall 68 and of size and configuration so that the movement of lever end portion 80 up and down is not restricted. End portion 78 extends into the path of the flange 58 at a location intermediate the full arc 0 of rotation of said plate 50. The end 78 of the lever 76 is tethered to the wall 66 of the formation 64 by a spring wire 88. An electrical lead 90 is secured to the electromagnetic wafer 72 and brought through the wall 68. The bared portion 48 of cable 26 is secured tightly to the platform 50 by clamp 92 at a location closely adjacent flange 56. As shown in FIG. 5, the clamp plate 94 of clamp 92 is provided with a shallow transverse groove 96 to accommodate the bared portion 48 of cable 26. The open ends 98 of groove 96 are coined to define a smooth tapered entrance and/or exit respectively for the bared portion 48. When the clamp 92 is tightened, the cable portion 48 is incapable of being moved, although the cable 26 is movable relative to the sheath 28 surrounding same along the unbared remaining portions thereof.

Accordingly, pulling on the handle 36 of the hood release 18 will cause the platform 50 to rotate along the full length of the arc 0 until such rotation is stopped by the upstanding flange 60. Return coil spring 100 is secured to the flange 56 and to the guide clamp 44 so that the platform 50 is automatically returned when the cable 26 is released. The full rotation of platform 50 through full angle Θ is required to enable release of the latch 22 from the keeper 24. If the stop 58 is intercepted as it moves along the path following arc Θ, say by the end portion 78 of lever 76, and its travel is stopped short of the full angle Θ, release of the latch 22, and hence release of the hood 12 is prevented.

The end portion 78 of lever 76 is brought into intercepting condition or position along the path of flange 58 by energization of the electromagnetic wafer 72. This can be effected by actuation of switch means 102 connected to the said wafer 72 and to the electrical system of the vehicle, said switch means 102 being mounted within the passenger section of the vehicle 10 and accessible to the operator. The switch means 102 can be key controlled.

When the cable 24 is pulled, and since the bared portion 48 thereof cannot move, the platform 50 is rotated. The portion 48 is twisted into a "S" configuration when the platform 50 is rotated. During the course of operation, considerable strain and wear is borne by the curved sections 104 of said cable portion 48 as it is flexed. In the absence of the flared entrance and exits of groove 96 the cable could fray and become severed, substantially reducing the expected operating life of the assembly 20. Providing the smooth tapered open ends 98 of groove 96 resulting from the coining earlier described at the entrance and/or exit of the groove 96 in which the bared portion 48 is fixed, alleviates the otherwise relative sharp corners and hence reduces frictional wear on said bared cable portion 48.

It is advantageous to provide means 106 for manually releasing the lever 76 should the lever jam orotherwise remain in its blocking condition when the electromagnetic wafer 72 is energized. In order to be effective, the manually operated means 106 provided for releasing the lever 76 from its blocking condition must not be readily visible or accessible to any "outsider". Therefore, for example, working manual release means 106 for the blocker assembly 20 may be provided by forming an opening in the end portion 80 of lever 76 and threading a thin wire or braided cable 110 through the opening 108. A cross-bar 112 or knot may be formed at said cable end 114. The opposite end 116 of the thin wire or braided cable 110 is permitted to hang free. The wire 110 is sufficiently long so that end 116 can to be grasped from the underside of the vehicle. The end portion 78 of the lever 76 can be raised out of path interfering condition simply by pulling the wire end 116 in a downward direction. A stop button 118 is provided on the base plate 42 so that the platform plate 50 returns to its proper rest dispostion under the force of spring return. Thus, the rotation of the platform is limited to the extent of the arc Θ.

Referring now to FIG. 6, a modified embodiment of the invention is illustrated and designated by reference character 120. Assembly 120 is identical to assembly 20 but for the substitution of the dead bolt mechanism 122 for the electromagnetic wafer 72, the mechanical operation thereof being in lieu of the electrical operation of assembly 20. In place of lever 76, a mechanical dead bolt 124 is employed, shown in withdrawn condition in full lines and in blocking condition in phantom line representation 124'. Rod 125 extends through wall 130 and is sheathed at 126 to extend rearward from the dead bolt housing 128 and is coupled to a key-operated mechanism represented by reference character 129 which can be located at the dashboard within the passenger section of the vehicle 10, said key operated mechanisms 129 being provided in substitution for the switch means 102 employed in respect of the assembly 20.

The assembly 120 comprises a pair of spaced upright walls 130 and 132 and unitary connecting base 134 which is fastened to the base plate 42. A cover (not shown) is provided. The dead bolt 124 is disposed within housing 128. When the dead bolt 124 is in unlocked condition, it is withdrawn into the housing 128. When the dead bolt 124 is in locked condition, as shown in phantom line representation 124', it extends outward of wall 130 into intercepting condition relative the flange 58 and will prevent rotation of platform 50 to the full extent of limited arc Θ. When bolt 124 is withdrawn, full rotation is possible so that the hood can be released.

Many variations in the size, configuration and arrangement of the individual components described herein can be effected by ones skilled in the art without departing from the spirit and scope of the invention as claimed in the appended claims.

What I claim is:

1. A remotely operable blocker assembly for a vehicle hood lock release mechanism, said mechanism including a pivotable latch and a keeper, said pivotable latch retained by the keeper and a cable coupled to the latch and manipulatable to release the latch from the keeper permitting release of the hood, said blocker assembly comprising: a base plate mounted along a length of the cable, guide means for leading a length of the cable through said assembly, platform means journaled on said base plate for rotation through a limited arc, said platform means secured to said length of said cable so that the full extent of said arc is required to release the latch, an upstanding stop on said platform means and rotatable therewith, means projectable across the path of said upstanding stop to interfere with passage thereof through the full extent of said limited arc and remote means for operating said projectable means between the interferent and noninterferent condition.

2. The blocker assembly as claimed in claim 1 including clamp means secured to said platform means, said cable provided with a sheath, said length of cable having a portion bared of said sheath and said bared portion being clamped to said platform means, whereby manipulation of said cable effects rotation of said platform means along said limited arc.

3. The blocker assembly as claimed in claim 2 in which said clamp means comprise a plate and fastening means tightly securing said plate to said platform means at a location spaced from said stop, said plate having a surface facing said platform means and a transverse groove formed herein, said bared cable portion being seated within said groove.

4. The blocker assembly as claimed in claim 3 in which said groove has at least one coined portion at least at one of the exit and entrance thereto to define a smooth tapered entrance and/or exit respectively for said bared portion and reduce frictional wear thereon.

5. The blocker assembly as claimed in claim 1 including means operable manually to release said projectable means from said interferent condition.

6. The blocker assembly as claimed in claim 1 wherein said projectable means comprise an elongate member having a pair of opposite end portions and a mid-portion, a housing having opposite walls and slot means in said walls suitable for receiving said elongate member mounted therethrough, an electromagnet seated within said housing below said mid-portion, resiliient means secured to said electromagnet and said mid-portion spacing same, electrical circuit means coupled to said electromagnet for energizing same, one end of said elongate member extending across the path of said stop, said one end normally being in interferent condition relative said path of said stop and in non-interferent condition when said electromagnet is energized.

7. The blocker assembly as claimed in claim 5 in which said manually operable means comprise a flexible length secured to the opposite end portion of said elongate member and extending toward an underside of the vehicle.

8. The blocker assembly as claimed in claim 1 in which said projectable means includes a housing having opposite end walls and located next adjacent said path, aperture means in said walls, a dead bolt assembly seated within said housing, said dead bolt assembly including a pin member of size and configuration suitable for passage through at least said aperture means formed in the housing wall next adjacent said path and in interferent relation thereto.

9. The blocker assembly as claimed in claim 1 in which said platform means comprise a planar plate member, means securing said plate member to said base plate journaled for rotation along a limited arc, a second stop on said plate member adjacent said guide means.

10. The blocker assembly as claimed in claim 9 including spring means secured to said guide means and said second stop to return said plate member to its initiate condition when said rotation thereof has been completed.

11. A remotely operated hood lock release blocker assembly for a vehicle having a hood latch and a cable secured to the hood latch, the cable being manipulatable to release the hood latch, said assembly comprising: a base plate mounted along a length of said cable, a rotatable platform connected to said cable and journaled on said base plate for rotation between a first condition and a second condition enabling release of the hood lock, blocker means intermediate said first and second conditions for preventing said platform from reaching the second condition, said blocker means including a blocking member disposed between a first interferent position intermediate the path of said platform preventing said platform from reaching the second condition and a second position permitting said platform to reach said second condition, and means operable upon said blocking member for placing same in one of said first or second positions.

12. The blocker assembly as claimed in claim 11 in which said blocking member comprises an electromagnetically controlled lever.

13. The blocker assembly as claimed in claim 11 in which said blocking member comprises a mechanically operated dead bolt.

14. The blocker assembly as claimed in claim 11 in which said cable is provided with a sheath and includes a portion bared of said sheath, said bared portion being flexed during limited rotation ofs aid platform, means for clamping said bared portion to said platform, said platform having an upstanding stop on a portion thereof, said blocking means intercepting said stop prior to the platform reaching its release condition.

15. The blocker assembly as claimed in claim 11 including means biasing said platform automatically to return same to its first condition when the cable is released.

16. The blocker assembly as claimed in claim 11 including means manually operable to release said blocking member from its interferent position.

17. The blocker assembly as claimed in claim 11 in which said blocking means comprise a lever having a pair of opposite end portions and a mid-portion, an electromagnet, said lever disposed overlying said mid-portion overlying said electromagnet, one end of said lever extending in interferent relationship with rotation of said platform when said electromagnet is de-energized and in non-interferent relationship when said electromagnet is energized, and electrical circuit means coupled to said electromagnet for energizing and de-energizing same.

18. The blocker assembly as claimed in claim 17 including means coupled to the other end of said lever for manually changing the condition of said lever from interferent condition to non-interferent condition.

19. The blocker assembly as claimed in claim 11 in which said blocking means comprise a dead bolt assembly including a bolt member capable of being thrust across said path of an upstanding stop on said platform in said first condition, and means for operating said dead bolt including remote key operated means.

* * * * *